US006538206B1

(12) United States Patent
Roberts

(10) Patent No.: US 6,538,206 B1
(45) Date of Patent: Mar. 25, 2003

(54) SPACER FOR AN INSULATOR ASSEMBLY

(75) Inventor: Gerald B. Roberts, Paris, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/961,346

(22) Filed: Sep. 25, 2001

(51) Int. Cl.[7] ..... H01B 17/00

(52) U.S. Cl. ..... 174/138 G; 174/138 R; 174/176; 200/48 R

(58) Field of Search ..... 174/138 G, 138 R, 174/148, 138 F, 154, 158 R, 168, 169, 176; 248/49, 58; 200/48 R, 48 KB, 48

(56) References Cited

U.S. PATENT DOCUMENTS

| | | | | | |
|---|---|---|---|---|---|
| 3,553,412 | A | * | 1/1971 | Kerr, Jr. | 200/48 R |
| 3,855,433 | A | * | 12/1974 | Bernatt et al. | 200/48 R |
| 3,914,001 | A | | 10/1975 | Nelson et al. | |
| 4,288,656 | A | | 9/1981 | Olashaw | |
| 4,298,771 | A | | 11/1981 | Olashaw | |
| 4,644,096 | A | | 2/1987 | Gutierrez et al. | |
| 5,071,368 | A | | 12/1991 | Garritano et al. | |
| 5,453,027 | A | | 9/1995 | Buell et al. | |
| 5,483,030 | A | * | 1/1996 | Bridges | 200/48 KB |
| 5,579,217 | A | | 11/1996 | Deam et al. | |
| 5,874,900 | A | * | 2/1999 | Panto | 200/48 A |
| 6,172,866 | B1 | * | 1/2001 | Skold et al. | 200/48 R |
| 6,222,134 | B1 | * | 4/2001 | Aoyama et al. | 174/158 F |
| 6,326,567 | B1 | * | 12/2001 | Sciarra | 200/48 R |

FOREIGN PATENT DOCUMENTS

| | | |
|---|---|---|
| GB | 693466 | 7/1953 |

* cited by examiner

*Primary Examiner*—Dean A. Reichard
*Assistant Examiner*—Jinhee Lee

(57) ABSTRACT

An insulator assembly has a spacer for conducting electrical current from the terminal pad of a bypass switch assembly to the contact of a switch assembly. The insulator assembly has a base. A first switch assembly is connected to the base and has a first switch blade movable between open and closed positions. A second switch assembly is connected to the base and has a second switch blade movable between open and closed positions. A bypass switch assembly is connected to the base and has a bypass switch blade movable between open and closed positions. The bypass switch assembly has a first conductor electrically connected to the bypass switch blade when the bypass switch blade is in the closed position. A support member is connected to the first conductor and has an opening. A second conductor is electrically connected to the first switch blade when the first switch blade is in the closed position. A spacer is disposed in the support member opening to transfer electrical current from the first conductor to the second conductor. The spacer has a first surface in electrical contact with the first conductor and has a second surface in electrical contact with the second conductor.

11 Claims, 7 Drawing Sheets

SPACER FOR AN INSULATOR ASSEMBLY

This application is related to U.S. patent application Ser. No. 09/961,402, entitled Terminal Pad for an Insulator Assembly; U.S. Ser. No. 09/961,333, entitled Mounting Bracket for an Insulator Assembly; and U.S. Ser. No. 09/961,334, entitled Base Assembly for an Insulator Assembly, all concurrently filed herewith in the name of Gerald B. Roberts, the subject matter of each of which is hereby incorporated by reference.

FIELD OF THE INVENTION

The present invention relates to an insulator assembly. More particularly, the present invention relates to an insulator assembly having a spacer for conducting electrical current from the terminal pad of a bypass switch assembly to the contact of a switch assembly.

BACKGROUND OF THE INVENTION

Distribution reclosers are mounted to support structures in electrical power distribution systems to prevent longer than momentary disruptions of electrical service, such as might be caused by a short circuit, and to provide continuous electric service. For example, wind conditions often cause power lines strung between poles to swing, thereby momentarily touching each other or a grounded conductor. Additionally, objects may fall across exposed wires, arcing could occur, or other transitory events could cause momentary power line short circuits or current surges that could burn out a fuse or trip a circuit breaker. Most of these faults are self correcting and do not require permanent fuse or circuit breaker protection because they terminate quickly. Reclosers sense and interrupt fault currents and automatically restore service after momentary outages after the temporary fault condition is gone. If a fault is permanent, the recloser locks open after a preset number of operations and isolates the faulted section of the system from the main system.

Bypass switch assemblies may be used to provide an economical and practical method of bypassing current and disconnecting distribution reclosers to provide maintenance to the reclosers without interrupting electrical service. Once the recloser has been isolated from the electrical distribution system, maintenance may be performed on the recloser without impairing continuous electric power.

Insulator assemblies are spaced from the support structures to which they are attached, such as utility poles. The sizes of switches and conductors are based upon the current and basic insulation level requirements. The stiffness of a conductor increases as the diameter of the conductor increases. Stiffer conductors are less flexible, thereby preventing them from being easily formed to facilitate connecting with connectors on terminal pads and maintaining electrical clearance on grounded parts. Terminal pads for existing switch assemblies are flat, thereby requiring some forming of conductors to connect to bypass switch assemblies that are mounted near the support structure. Due to the stiffness of large conductors, difficulty exists in forming to the degree necessary to connect to the straight terminal pads of existing insulator assemblies that are mounted near the support structures. Therefore, it is difficult to connect large conductors to terminal pads of existing insulator assemblies that are mounted close to support structures due to the inflexibility of the conductor. A need exists for a terminal pad that allows conductors to be connected to insulator assemblies that are mounted near support structures.

Insulator assemblies are mounted to support structures using multi-piece mounting assemblies. Such multi-piece mounting assemblies are unwieldy as they require a technician to carry a number of different parts in the field. Moreover, installation is difficult and slow due to the number of parts that must be assembled. Therefore, a need exists for a mounting assembly for an insulator assembly that has few parts and is quick and easy to install.

Insulator assemblies are supported on base assemblies that are bolted together, which allow movement of the parts of the base assemblies over time. Such movement is due to many uncontrollable events, such as weather, animals, vandalism and the operation of the switches mounted on the base assemblies. Movement of the base assemblies causes the blade and contact of the insulator assemblies to move out of alignment, thereby effecting electricity transfer through the insulator assembly. Therefore, a need exists for a base assembly for an insulator assembly that is rigidly connected and is not prone to movement over time.

Elaborate shunting devices are needed to transfer electricity from the terminal pads to the contacts of switch assemblies of insulator assemblies when the bypass blades of bypass switch assemblies are in open positions, which is the normal operating position for bypass switch assemblies. The shunting devices are bulky and difficult to install. Therefore, a need exists for a bypass switch assembly that transfers electric current from the terminal pad of a bypass switch assembly to the contact of a switch assembly of an insulator assembly without a shunting device.

Therefore, a need exists for improved insulator assemblies.

SUMMARY OF THE INVENTION

Accordingly, it is an objective of the present invention to provide a spacer for transferring electrical current from terminal pads to the contacts of switch assemblies of insulator assemblies when the bypass blades of bypass switch assemblies are in open positions, thereby eliminating the need for an elaborate shunting mechanisms.

The foregoing objective is basically attained by providing an insulator assembly having a base. A first switch assembly is connected to the base and has a first switch blade movable between open and closed positions. A second switch assembly is connected to the base and has a second switch blade movable between open and closed positions. A bypass switch assembly is connected to the base and has a bypass switch blade movable between open and closed positions. The bypass switch assembly has a first conductor electrically connected to the bypass switch blade when the bypass switch blade is in the closed position. A support member is connected to the first conductor and has an opening. A second conductor is electrically connected to the first switch blade when the first switch blade is in the closed position. A spacer is disposed in the support member opening to transfer electrical current from the first conductor to the second conductor. The spacer has a first surface in electrical contact with the first conductor and has a second surface in electrical contact with the second conductor. The spacer provides a path for the electrical current from the terminal pad of the bypass switch assembly through the steel support member to a contact of a first switch blade of a first switch assembly, thereby eliminating the need for an elaborate shunting mechanism to provide a path for the electrical current around the steel support member.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 4:
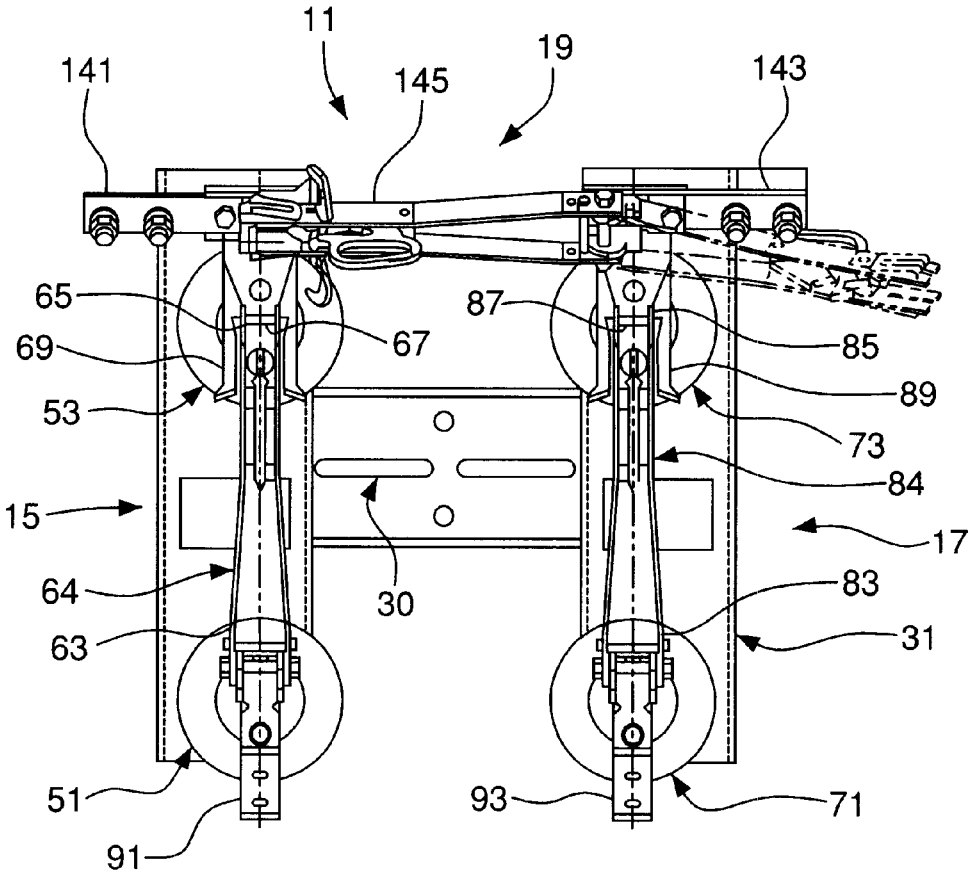
FIG. 4 is a top plan view of the insulator assembly of FIG. 2.

As shown in FIGS. 1–15, the present invention relates to an insulator assembly 11 for a recloser assembly 13. The insulator assembly 11 includes two switch assemblies 15 and 17 and a bypass switch assembly 19, as shown in FIG. 4. The insulator assembly 11 provides economical and simple electrical bypassing and electrical disconnecting of the recloser assembly from the electrical distribution system. Switch assemblies 15 and 17 and bypass switch assembly 19 are mounted on a base assembly 31. A mounting bracket 41 connected to the base assembly 31 secures the insulator assembly to a support 21, such as a utility pole.

The first switch assembly 15, as shown in FIGS. 1–4, has first and second insulators 51 and 53, respectively. First insulator 51 has first and second end fittings 55 and 57, respectively, attached at opposite ends of the first insulator. Second insulator 53 also has first and second end fittings 59 and 61 attached at opposite ends of the second insulator. The first end fittings 55 and 59 of insulators 51 and 53 receive fasteners for mounting each insulator to a base assembly 31. A first end 63 of a first switch blade 64 is pivotally connected to the second end fitting 57 of the first insulator 51. A second end 65 of the first switch blade 64 is engaged with a first contact 67 that is connected to the second end fitting 61 of the second insulator 53. A first hook 69 connected to the second end fitting 61 guides the first switch blade 64 into electrical contact with the first contact 67 during closing of the first switch assembly 15.

The second switch assembly 17, as shown in FIG. 4, is assembled similarly to the first switch assembly 15. The second switch assembly 17 has first and second insulators 71 and 73, respectively. First insulator 71 has first and second end fittings, similar to end fitting 55 and 57, attached at opposite ends of the first insulator. Second insulator 73 also has first and second end fittings, similar to end fitting 59 and 61, attached at opposite ends of the second insulator. The first end fittings of insulators 71 and 73 receive fasteners for mounting each insulator to a base assembly 31. A first end 83 of a second switch blade 84 is pivotally connected to the second end fitting of the first insulator 71. A second end 85 of the second switch blade 84 is connected to a second contact 87 that is connected to the second end fitting of the second insulator 73. A second hook 89 connected to the second end fitting guides the second switch blade 84 into electrical contact with the second contact 87 during closing of the second switch assembly 17.

As shown in FIGS. 1–4, first terminal pad 91 is connected between the second end fitting 57 of the first insulator 51 of the first switch assembly 15 and the first end 63 of the first switch blade 64. As shown in FIG. 4, second terminal pad 93 is connected between the second end fitting of the first insulator 71 of the second switch assembly 17 and the first end 83 of the second switch blade 79.

Figure 5:
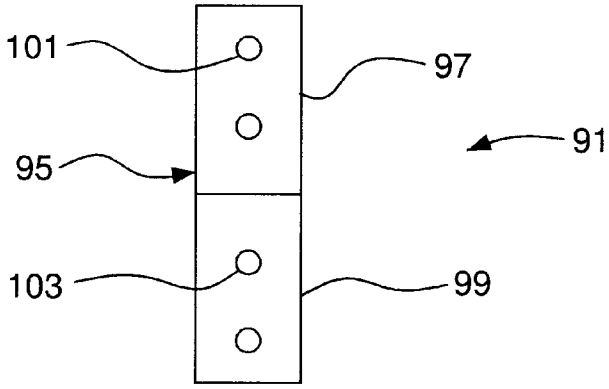
FIG. 5 is a top plan view of a terminal pad of the insulator assembly of FIG. 1.

As shown in FIGS. 1–5, the first terminal pad 91 has a base 95 having angularly oriented first and second portions 97 and 99, respectively. Preferably, the first and second portions 97 and 99 are integrally connected. Preferably, the angle 98 (FIG. 2) between first and second portions 97 and 99 is less than 180 degrees. More preferably, angle 98 is approximately 120 degrees. A first opening 101 in the first portion 97 facilitates connecting the first terminal pad 91 to the second end fitting 57 of the first insulator 51 of the first switch assembly 15. A second opening 103 in the second portion 99 receives a fastener to facilitate connecting a connector 105 (FIG. 1) to the first terminal pad 91. Preferably, as shown in FIG. 5, there are two first openings 101 and two second openings 103. Second terminal pad 93 is constructed similarly to first terminal pad 91.

Figure 6:
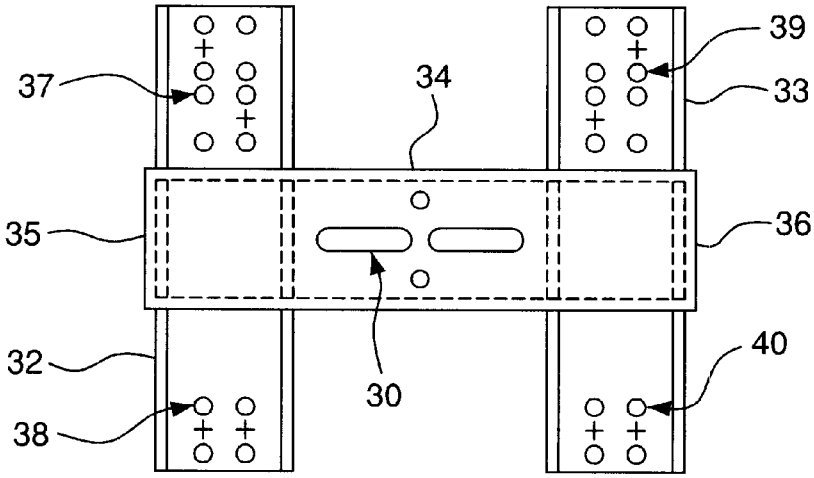
FIG. 6 is a top plan view of a base assembly of the insulator assembly of FIG. 1.
Figure 7:
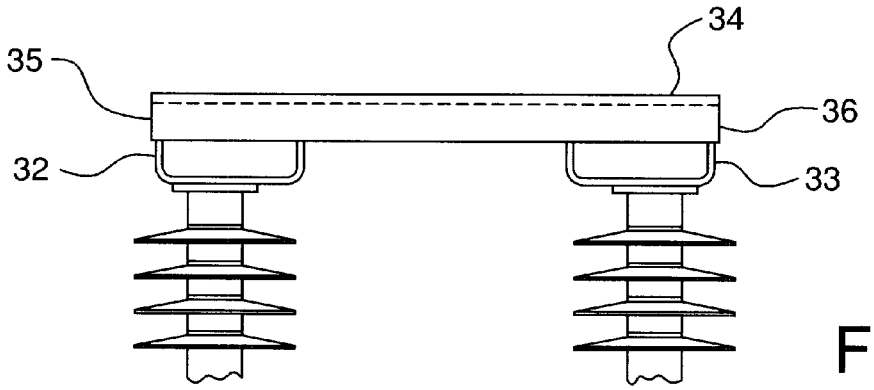
FIG. 7 is a front elevational view of the base assembly of FIG. 6, showing insulators mounted to the base.

Base assembly 31, shown in FIGS. 6–7, has a first, second and third support members 32, 33 and 34, respectively. Preferably, each of the support members is substantially U-shaped, as shown in FIG. 7. A first end 35 of third support member 34 is attached to first support member 32. A second end 36 of third support member 34 is attached to second support member 32. Preferably, third support member 34 is welded to first and second support members 32 and 33, respectively, thereby providing a rigid base assembly 31. Preferably, as shown in FIG. 6, first and second support members 32 and 33 are substantially parallel and third support member 34 is substantially perpendicular to both first and second support members.

First support member 32 has first and second pluralities of holes 37 and 38, respectively, for receiving first and second insulators 71 and 73 of the second switch assembly 17. Second support member 33 has second and third pluralities of holes 39 and 40 for receiving first and second insulators 51 and 53 of first insulator assembly 15. Each of the first, second, third and fourth pluralities of holes 37, 38, 39 and 40 are adapted to receive a variety of insulator configurations, thereby providing versatility to the base assembly. Third support member has a fifth plurality of holes 30 for connecting to a support structure or to the mounting bracket 41.

Figure 1:
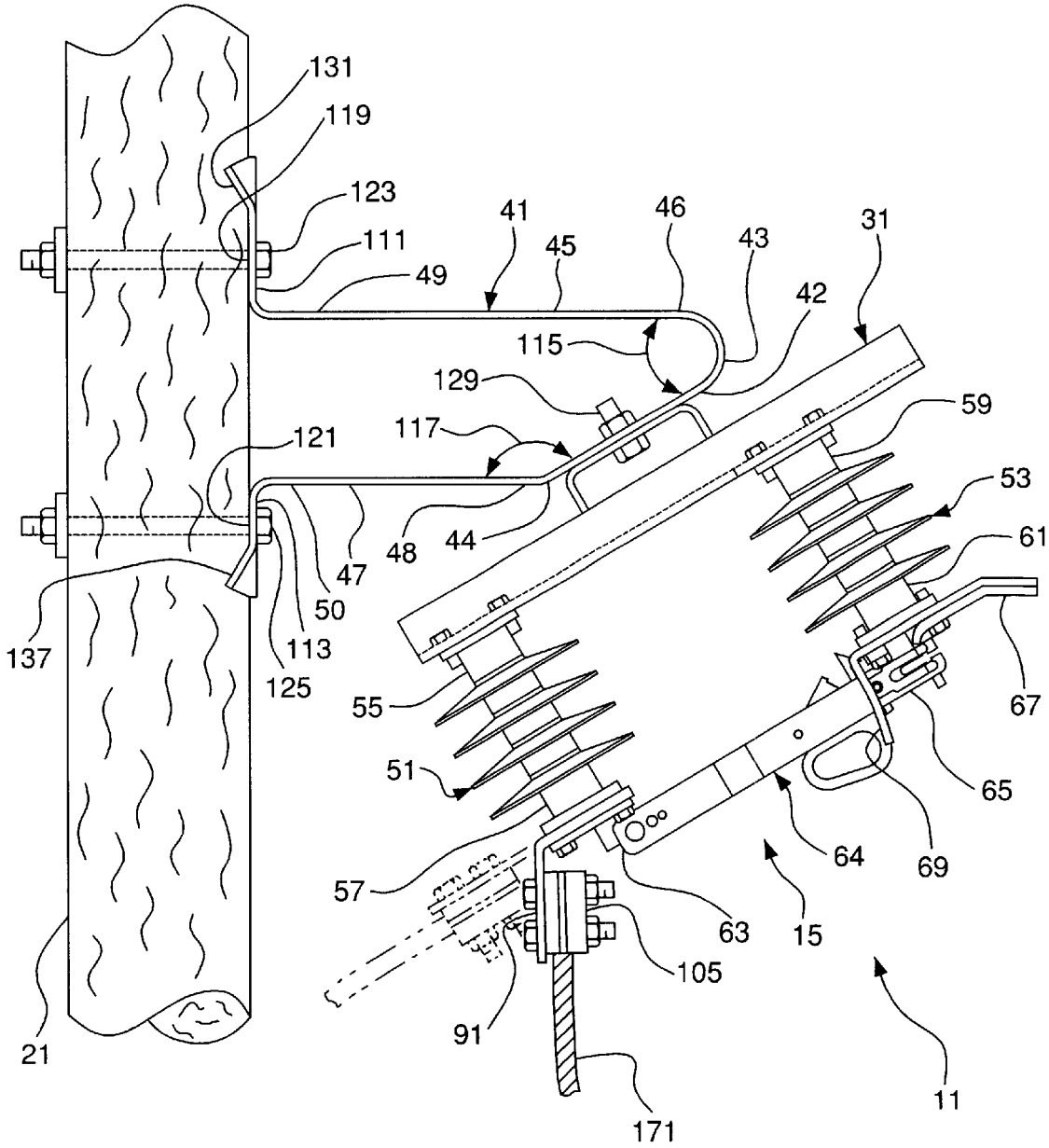
FIG. 1 is a side elevational view of an insulator assembly according to the present invention mounted to a support and receiving a conductor.
Figure 8:
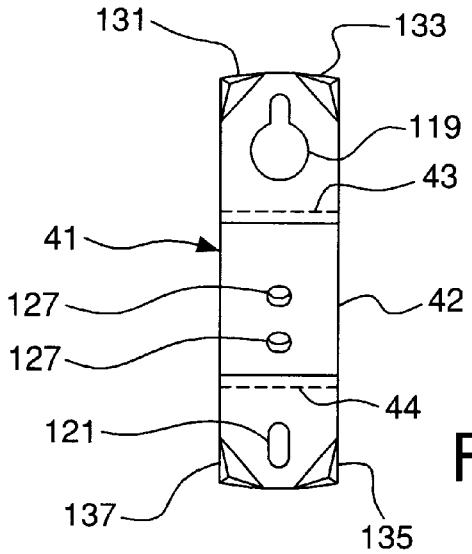
FIG. 8 is front elevational view of a mounting bracket of the insulator assembly of FIG. 1.
Figure 9:
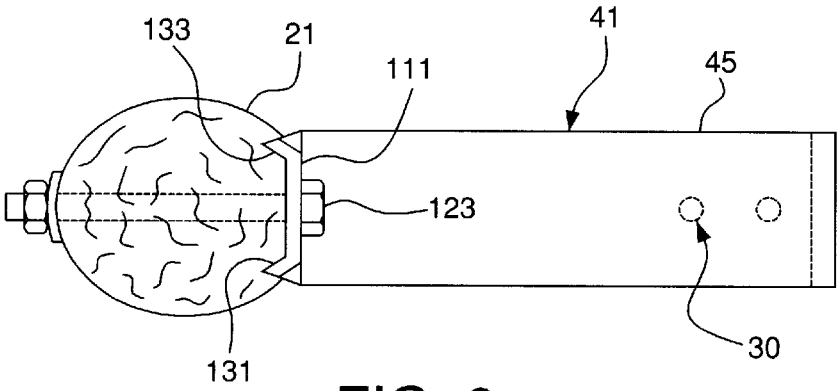
FIG. 9 is a top plan view of the mounting bracket of FIG. 8, showing the mounting bracket secured to a support.
Figure 10:
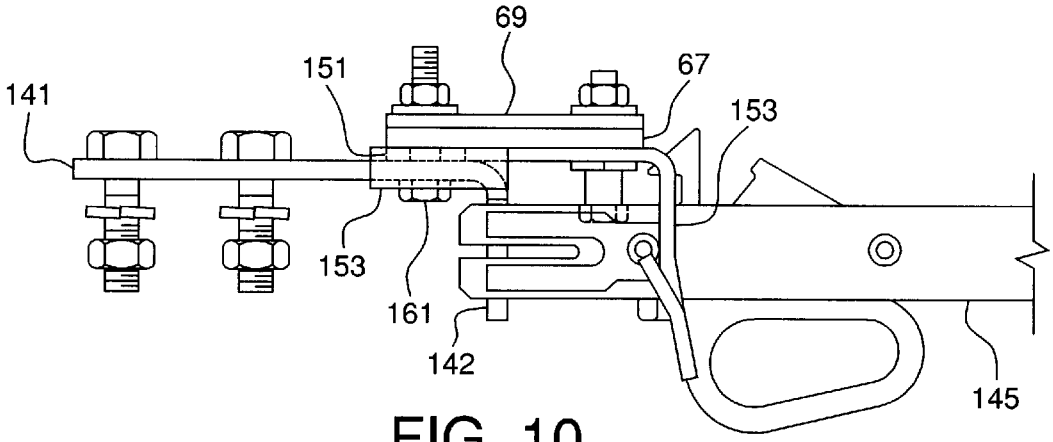
FIG. 10 is a side elevational view of the bypass switch assembly of FIG. 2, showing the bypass blade in a closed position.
Figure 11:
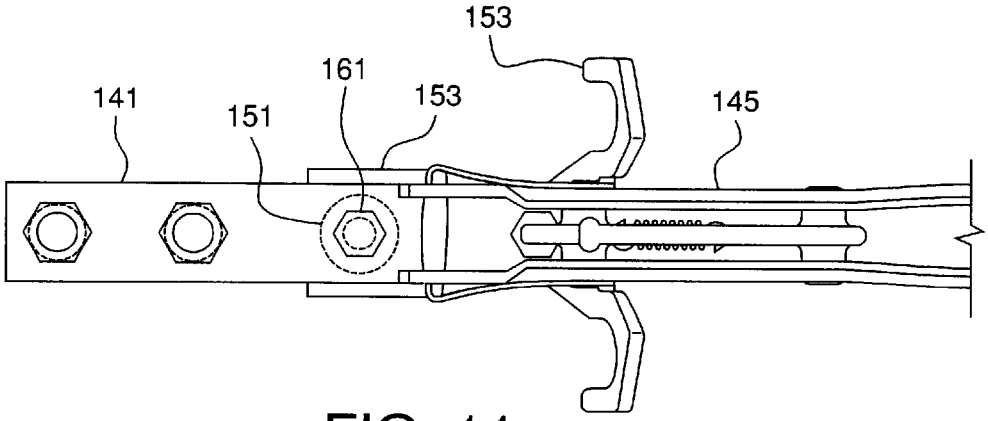
FIG. 11 is a top plan view of the bypass switch assembly of FIG. 10.
Figure 12:
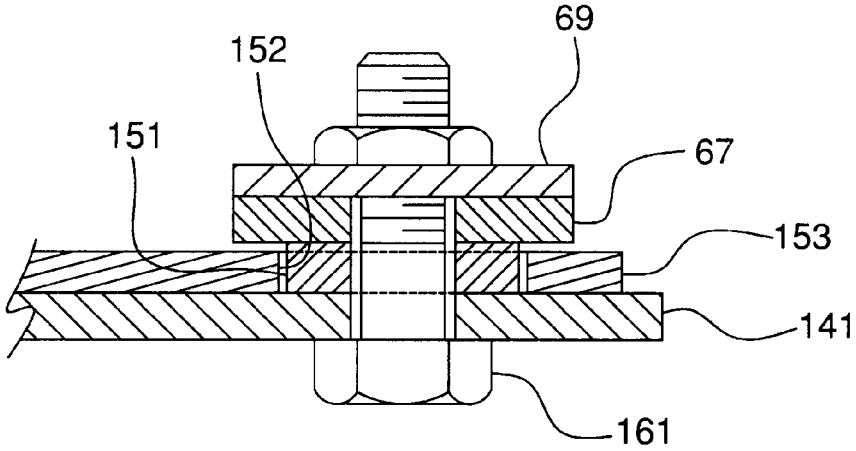
FIG. 12 is a partial side elevational view in cross section of a spacer of the bypass switch assembly of FIG. 10.
Figure 13:
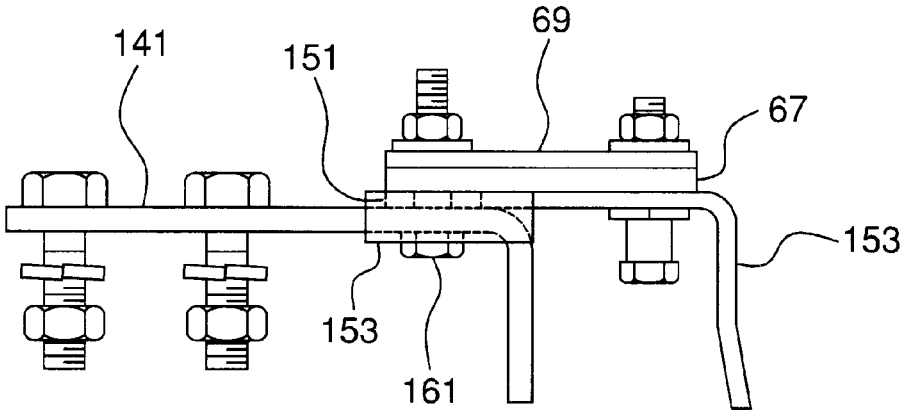
FIG. 13 is a side elevational view of the spacer of the bypass switch assembly of FIG. 10, in which the bypass blade is in an open position.

Mounting bracket 41, as shown in FIGS. 1 and 7–8, has a base 42 having first and second ends 43 and 44, respectively. A first leg 45 has a first end 46 attached to the first end 43 of the base 42. Preferably, angle 115 between first leg 45 and base 42 is approximately 30 degrees. A second leg 47 has a first end 48 attached to the second end 44 of the base 42. Preferably, angle 117 between second leg 47 and base 42 is approximately 150 degrees. Preferably, first leg 45 and second leg 47 are substantially parallel. A first foot 111 extends from second end 49 of first leg 45. A second foot extends 113 from second end 50 of second leg 47. Preferably, first foot 111 and second foot 113 extend in opposite directions from first and second legs 45 and 47, respectively. Preferably, base 42, first leg 45, first foot 111, second leg 47 and second foot 113 are integrally connected.

Fastener holes 119 and 121 in first and second feet 111 and 113, respectively, receive fasteners 123 and 125 to secure mounting bracket 41 to a support 21, such as a utility pole. Fastener hole 127 in base 41 receives fastener 129 to secure mounting bracket 41 to base assembly 31.

Corners 131, 133, 135 and 137 of first and second feet 111 and 113 of mounting bracket 41 are bent toward support structure 21 to provide a more secure attachment to the support structure. Bent corners 131, 133, 135 and 137 dig into support structure as 123 and 125 are tightened, thereby providing additional stability to the insulator assembly 11 during the lifetime of the insulator assembly 11.

The bypass switch assembly 19, as shown in FIGS. 1,4 and 10–11, allows for quick and easy bypassing and disconnecting of the recloser assembly 13 from the electrical distribution system. The bypass switch assembly 19 is shown in a closed position in FIG. 4; an open position is shown with phantom lines. The bypass switch assembly 19 has first and second terminal pads 141 and 143, respectively, for receiving and transferring electrical current. Connectors (not shown) may be attached to terminal pads 141 and 143 to receive electrical conductors. A bypass blade 145 transfers electrical current from first terminal pad 141 to second terminal pad 143 when in a closed position, as shown in FIG. 4. In normal operation, bypass blade 145 is in an open position, as shown in phantom lines in FIG. 4, and first and second switch blades 64 and 84 are in a closed position to transfer electrical current to and from the recloser assembly. Closing bypass blade 145 and opening first and second switch blades 64 and 84 electrically isolates the recloser assembly from the electrical distribution system by transferring the electrical current from the first terminal pad 141 to the second terminal pad 143, thereby bypassing the first and second switch assemblies 15 and 17.

When the bypass switch assembly is in the open position, a spacer 151, as shown in FIGS. 10–14, transmits electrical current from the first terminal pad (first conductor) 141 to a contact (first latch or second conductor) 67 of the first switch blade 64 of the first switch assembly 15. When the bypass blade 145 is closed, the spacer 151 serves no function since electrical current is not transferred to the first switch blade 64 since it is in an open position. The spacer 151 eliminates the need for an elaborate shunting mechanism by providing a path for the electrical current from the terminal pad 141 through the steel support member 153 to the contact 67 of the first switch blade 64. The spacer 151 is disposed in an opening 152 in the steel support member 153 to provide a pathway for the electrical current through the steel support member.

Spacer 151 is disposed in opening 152 in steel support member 153. The steel support member provides the same function as that of the first hook 69 of the first switch assembly 15, i.e., facilitates closing of the bypass blade 145 and connecting with contact end 142 of first terminal pad 141. Preferably, spacer 151 is thicker than the steel support member 153, thereby providing a good electrical contact between the first terminal pad 141 of the bypass assembly 19 and the contact (first latch) 67 of the first switch assembly 15. Fastener 161 secures bypass switch assembly terminal pad 141, steel support member 153, and first latch 67 and first hook of first switch assembly 15 together.

Assembly, Disassembly, and Operation

Figure 2:
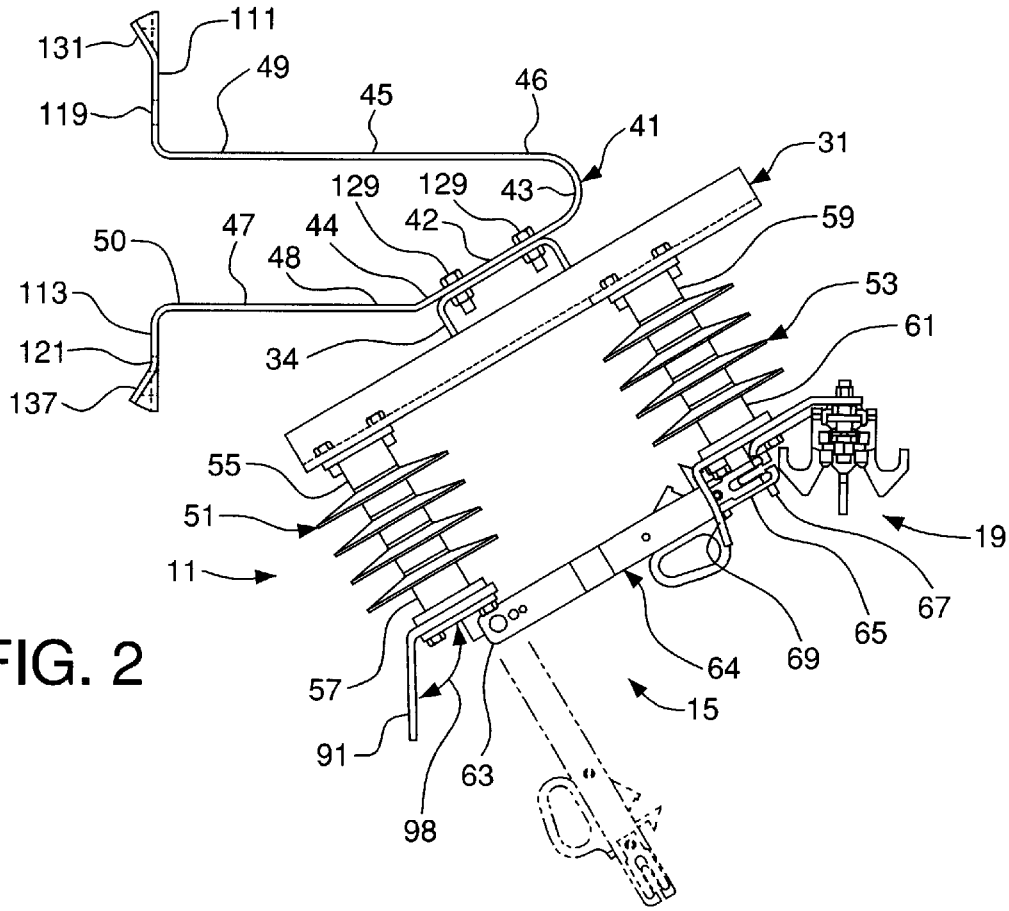
FIG. 2 is a side elevational view of the insulator assembly of FIG. 1 with a bypass switch assembly.
Figure 3:
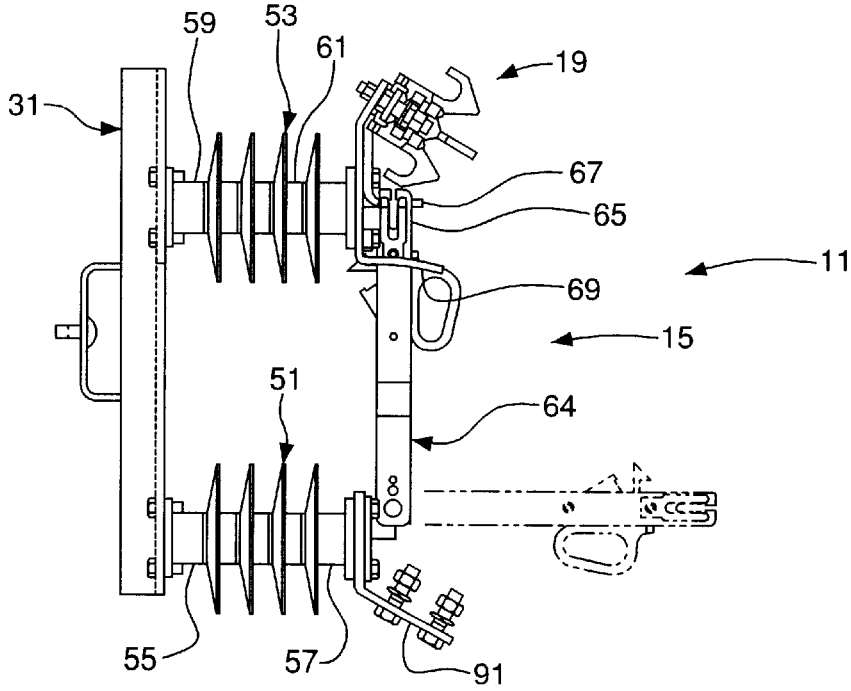
FIG. 3 is a side elevational view of the switch assembly of FIG. 2 without the mounting bracket.

An insulator assembly 11 according to the present invention is shown fully assembled in FIG. 2. The insulator assembly 11 has a base assembly 31 to which first and second switch assemblies 15 and 17 are mounted. A bypass assembly 19 may then be added by attaching a first end of the bypass switch assembly to the first switch assembly and attaching a second end of the bypass switch assembly to the second switch assembly, as shown in FIG. 4.

As shown in FIG. 2, the base assembly 31 is then secured by fasteners 129 to the mounting bracket 41. The base assembly 31 may be directly secured to a support structure without mounting bracket 41. The mounting bracket 41 is then secured using fasteners 123 and 125 to a support structure 21, as shown in FIG. 1. For reasons of clarity, the bypass switch assembly is not shown in FIG. 1. As fasteners 123 and 125 are tightened, bent corners 131, 133, 135 and 137 are drawn into support structure 21, thereby providing a secure attachment to the support structure.

Electrical conductors 171 from the recloser assembly 13 are then connected to connectors 105 attached to first and second terminal pads of first and second switch assemblies 15 and 17, respectively, as shown in FIG. 1. Electrical conductors (not shown) to and from the insulator assembly 11 are connected to first and second terminal pads 141 and 143 of the bypass switch assembly.

Figure 14:
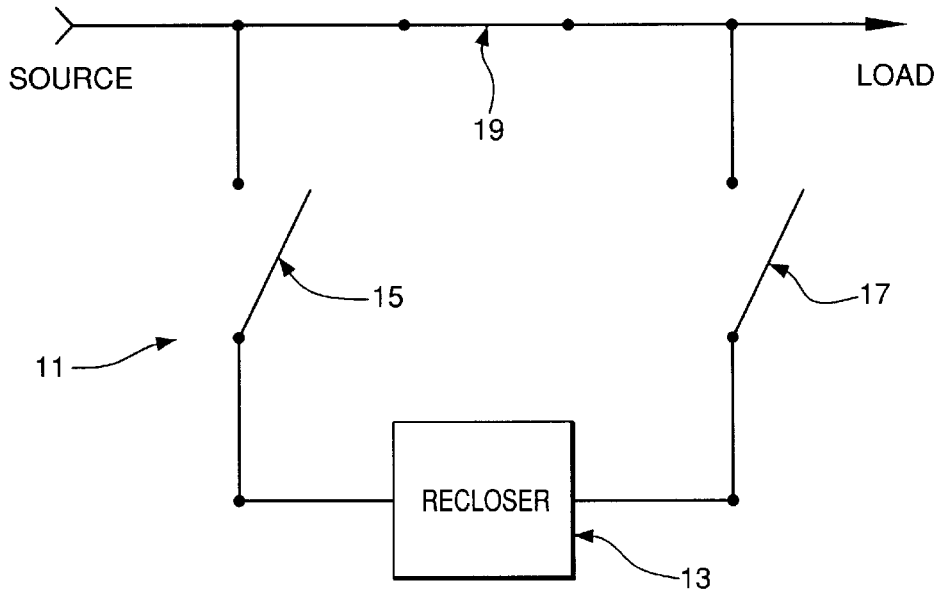
FIG. 14 is a circuit diagram of the bypass switch assembly, the switch assembly and the recloser assembly of the present invention, showing the bypass assembly in an open position and the switch assemblies in a closed position.
Figure 15:
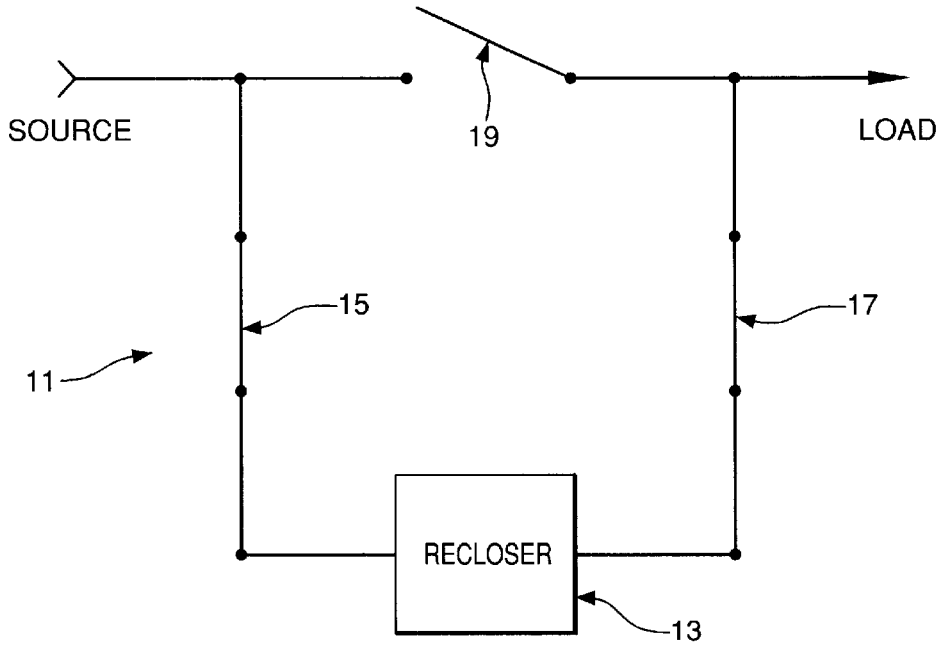
FIG. 15 is the circuit diagram of FIG. 14, showing the bypass assembly in a closed position and the switch assemblies in an open position.

Electrical circuit diagrams of the insulator assembly 11 and the recloser assembly 13 are shown in FIGS. 14 and 15. The normal operating mode is shown in FIG. 15. Electrical current is received at the first terminal pad 141 of bypass switch assembly 19 (FIG. 4). Since bypass switch assembly 19 is in the open position, the electrical current is prevented from traveling through the bypass switch assembly. The electrical current is transferred through the first switch assembly 15, through the recloser assembly 13 and through the second switch assembly 17. The electrical current is transferred to the second terminal pad 143 of the bypass switch assembly 19 and is then transferred from the insulator assembly 11.

The bypass mode of the insulator assembly 11 is shown in FIG. 14. Both the first and second switch assemblies 15 and 17 are in the open position and the bypass switch assembly 19 is in the closed position. Since the first switch assembly 15 is open, electrical current travels through the bypass switch assembly 19 and is then transferred from the insulator assembly 11, thereby bypassing the recloser assembly 13. The bypass mode electrically isolates the recloser assembly from the electrical distribution system so work may be performed on the recloser assembly.

While advantageous embodiments have been chosen to illustrate the invention, it will be understood by those skilled in the art that various changes and modifications may be made therein without departing from the scope of the invention as defined in the appended claims.

What is claimed is:

1. An insulator assembly, comprising:

a base;

a first switch assembly connected to said base and having a first switch blade movable between open and closed positions;

a second switch assembly connected to said base and having a second switch blade movable between open and closed positions;

a bypass switch assembly connected to said base and having a bypass switch blade movable between open and closed positions, said bypass switch assembly being electrically parallel to a series connection of said first and second switch assemblies and including a first conductor electrically connected to said bypass switch blade when said bypass switch blade is in the closed position, a support member connected to said first conductor and having an opening, and a second conductor electrically connected to said first switch blade when said first switch blade is in the closed position; and a spacer disposed in said support member opening to transfer electric current from said first conductor to said second conductor, said spacer having a first surface in electrical contact with said first conductor and having a second surface in electrical contact with said second conductor.

2. An insulator assembly according to claim 1, wherein said spacer is thicker than said support member.

3. An insulator assembly according to claim 1, wherein said spacer is copper.

4. An insulator assembly according to claim 1, wherein said first conductor is copper.

5. An insulator assembly according to claim 1, wherein said second conductor is copper.

6. An insulator assembly according to claim 1, wherein said support member is steel.

7. An insulator assembly for a switch assembly, comprising:

a base;

a first switch assembly connected to said base and having a first switch blade movable between open and closed positions;

a second switch assembly connected to said base and having a second switch blade movable between open and closed positions;

a bypass switch assembly connected to said base and having a bypass switch blade movable between open and closed positions, said bypass switch assembly being electrically parallel to a series connection of said first and second switch assemblies and including a first conductor electrically connected to said bypass switch blade when said bypass switch blade is in the closed position, a support member connected to said first conductor and having an opening, and a second conductor electrically connected to said first switch blade when said first switch blade is in the closed position; and a spacer disposed in said support member opening to transfer electric current from said first conductor to said second conductor, said spacer being thicker than said support member, said spacer having a first surface in electrical contact with said first conductor and having a second surface in electrical contact with said second conductor.

8. An insulator assembly according to claim 7, wherein said spacer is copper.

9. An insulator assembly according to claim 7, wherein said first conductor is copper.

10. An insulator assembly according to claim 7, wherein said second conductor is copper.

11. An insulator assembly according to claim 7, wherein said support member is steel.

* * * * *